US007036447B2

(12) United States Patent
Tsumiyama et al.

(10) Patent No.: US 7,036,447 B2
(45) Date of Patent: May 2, 2006

(54) JET-PROPULSION PERSONAL WATERCRAFT

(75) Inventors: Yoshinori Tsumiyama, Miki (JP); Minoru Kanamori, Rowland Heights, CA (US); Hironori Kato, Rancho Santa Margarita, CA (US)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/977,840

(22) Filed: Oct. 28, 2004

(65) Prior Publication Data

US 2005/0120938 A1 Jun. 9, 2005

(30) Foreign Application Priority Data

Oct. 31, 2003 (JP) ..... 2003-372056

(51) Int. Cl.
*B63B 59/02* (2006.01)

(52) U.S. Cl. ..... 114/219; 114/364; 114/88

(58) Field of Classification Search ..... 114/55.51, 114/219, 220, 364, 88
See application file for complete search history.

(56) References Cited

U.S. PATENT DOCUMENTS 4,627,373 A * 12/1986 Nishida ..... 114/219
5,743,204 A * 4/1998 Tweet ..... 114/219
5,743,206 A * 4/1998 Hattori ..... 114/55.51
6,776,114 B1 * 8/2004 Abe ..... 114/219

FOREIGN PATENT DOCUMENTS

JP 06-191466 7/1994

* cited by examiner

*Primary Examiner*—Lars A. Olson
(74) *Attorney, Agent, or Firm*—Alleman Hall McCoy Russell & Tuttle LLP

(57) ABSTRACT

A water-jet propulsion personal watercraft is disclosed, comprising a body formed by a hull and a deck covering the hull from above, the body having a joint portion joining the hull and the deck joined to each other at peripheries thereof, the body being configured to accommodate an engine configured to drive a propulsion system of the watercraft, and a side bumper mounted to the joint portion at a side portion of the body, wherein the side bumper includes a base portion mounted to the joint portion to extend along the joint portion in a longitudinal direction of the watercraft, and a protruding portion configured to extend along the base portion in the longitudinal direction and to protrude downward from a lower surface of the base portion to be spaced apart from a side wall of the hull.

14 Claims, 8 Drawing Sheets

JET-PROPULSION PERSONAL WATERCRAFT

BACKGROUND OF THE INVENTION

1. Field of the Invention

The present invention relates to a water-jet propulsion personal watercraft. More particularly, the present invention relates to a structure of a bumper equipped in a water-jet propulsion personal watercraft.

2. Description of the Related Art

In recent years, jet-propulsion personal watercraft have been widely used in leisure, sport, rescue activities, and the like. A typical personal watercraft includes an engine mounted within a body formed by a hull and a deck. The engine drives a water jet pump, which pressurizes and accelerates water sucked from a water intake generally provided on a bottom surface of the hull and ejects it rearward from an outlet port. Thereby, the personal watercraft is propelled. In the personal watercraft disclosed in Japanese Patent No. 2671091, a sponson is mounted to a side surface of a rear portion of the hull to gain predetermined travel capability. The sponson is mounted to extend along a longitudinal direction of the watercraft and functions as a stabilizer capable of gaining predetermined travel capability in the watercraft.

The predetermined travel capability includes straight-ahead travel capability and turning capability which are required to be well balanced. To this end, the sponson is typically made relatively short and is mounted to only a part of the side surface of the hull substantially at a rear position. In addition, in recent years, there has been a need for improved turning capability.

SUMMARY OF THE INVENTION

The present invention addresses the above described condition, and an object of the present invention is to provide a jet-propulsion personal watercraft capable of improving turning capability while maintaining straight-ahead travel capability.

According to the present invention, there is provided a water-jet propulsion personal watercraft, comprising a body formed by a hull and a deck covering the hull from above, the body having a joint portion joining the hull and the deck joined to each other at peripheries thereof, the body being configured to accommodate an engine configured to drive a propulsion system of the watercraft, and a side bumper mounted to the joint portion at a side portion of the body, wherein the side bumper includes a base portion mounted to the joint portion of the hull and the deck to extend along the joint portion in a longitudinal direction of the body, and a protruding portion configured to extend along the base portion in the longitudinal direction and to protrude downward from a lower surface of the base portion to be spaced apart from a side wall of the hull.

In such a construction, when the watercraft is turning with the body inclined to the right or to the left, the side surface of the hull and the protruding portion of the side bumper contact the water surface, and a water flow is formed between the protruding portion and the side surface of the hull. Thus, the protruding portion functions as a stabilizer. In addition, since the protruding portion provided on the side bumper may be elongate along the joint portion at the side portion of the body, a length of a portion of the protruding portion which contacts the water can be increased during turning, and thereby the turning capability of the watercraft can be improved. Typically, the joint portion of the deck and the hull is exposed substantially over the water surface when the watercraft is traveling straight ahead, and a portion of the joint portion on one side (right or left) is submerged in water when the watercraft is turning. Therefore, in accordance with the above construction, while the watercraft is traveling straight ahead, the protruding portion does not substantially contact the water, thereby inhibiting an increase in travel resistance. Consequently, turning capability can be improved while maintaining the straight-ahead travel capability of the watercraft.

The water-jet propulsion personal watercraft may further comprise a front bumper mounted to the joint portion of the hull and the deck to be located at a front portion of the body, and a rear bumper mounted to the joint portion of the hull and the deck to be located at a rear portion of the body, wherein, the protruding portion of the side bumper extends over a length equal to not less than a half of a distance between the front bumper and the rear bumper. In this construction, since the length of the protruding portion of the side bumper is relatively large, the length of the portion of the protruding portion which contacts the water can be increased when the watercraft is turning. Therefore, the turning capability of the watercraft is improved.

A center of the protruding portion in the longitudinal direction may be located rearward in the body relative to a center of the body in the longitudinal direction. Since the center of gravity of the watercraft with the rider riding thereon is located relatively at the rear in the longitudinal direction, a rear portion of the joint portion of the hull and the deck tends to contact water as compared to a front portion of the joint portion when the watercraft is turning. In the above construction, since the rear portion of the protruding portion of the side bumper reliably contacts the water, the turning capability is also improved.

The protruding portion of the side bumper may be configured to protrude downward to be located lower than a lower surface of the front bumper as seen in a front view of the body. In this construction, water running from forward can be smoothly guided into a region between the protruding portion and the side surface of the hull.

The protruding portion of the side bumper may be configured to protrude downward to be located lower than a lower surface of the rear bumper as seen in a rear view of the body. In this construction, the water flow formed between the protruding portion and the side surface of the hull is not substantially inhibited by the rear bumper and ejected rearward of the body.

The water-jet propulsion personal watercraft may further comprise a seat mounted over the deck and configured to be straddled by a rider, wherein the watercraft may be a straddle-type watercraft on which a rider rides straddling the seat. In the case of a stand-up type personal watercraft on which a rider rides in a standing or kneeling position on a deck floor of a rear deck, the center of gravity of the body is located at a rear portion of the body during travel, while in the case of the straddle-type personal watercraft, the center of gravity is located near the center of the body during travel. So, the joint portion of the hull and the deck at the side portion of the body contacts the water in a wider range in the straddle-type personal watercraft than in the stand-up type personal watercraft. Accordingly, by applying the construction in which the long protruding portion extends along the joint portion of the side portion of the body to the straddle-type personal watercraft, the turning capability can be further improved. Nonetheless, by applying the above construction to the stand-up type personal watercraft, the similar function and effects can be obtained because of an increase in the length of the portion of the protruding portion which contacts the water.

The protruding portion may be located rearward in the body relative to a center of the body in the longitudinal direction.

The above and further objects and features of the invention will more fully be apparent from the following detailed description with accompanying drawings.

DETAILED DESCRIPTION OF THE PREFERRED EMBODIMENTS

Figure 1:
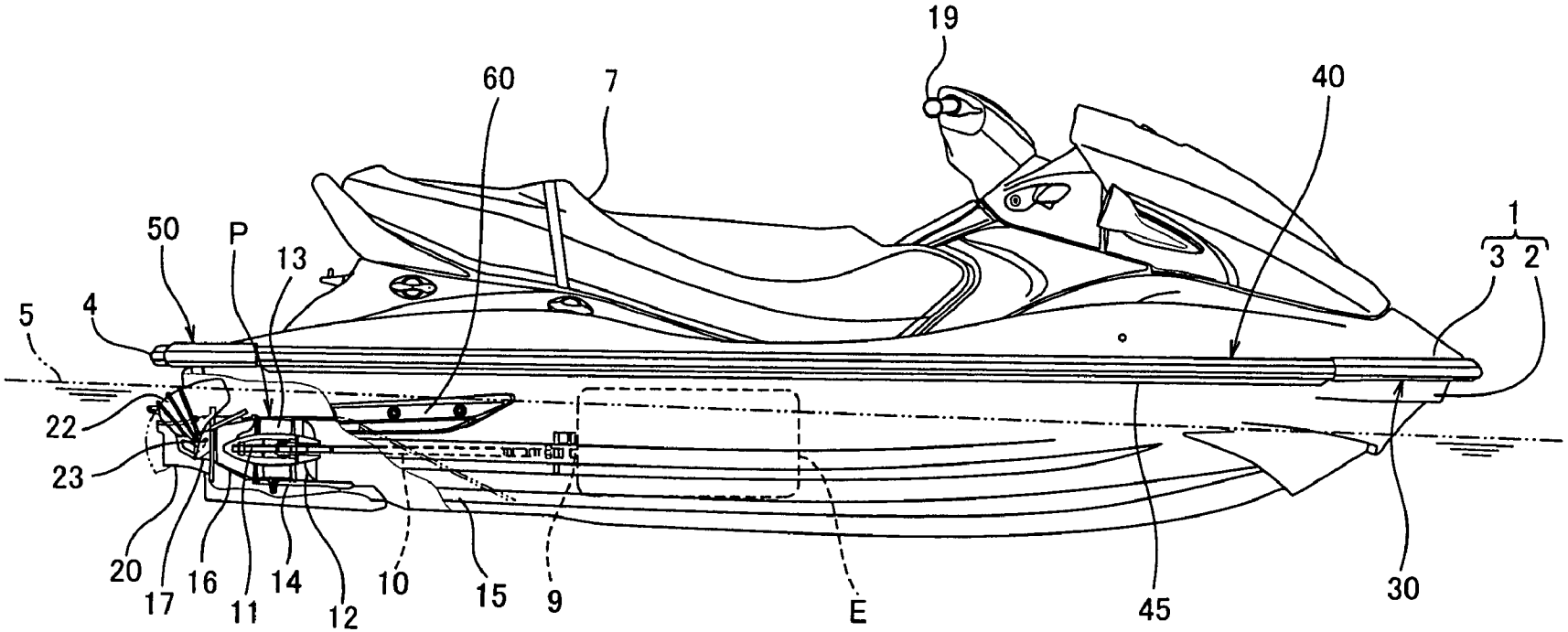
FIG. 1 is a side view of a personal watercraft according to an embodiment of the present invention.

Hereinafter, a water-jet propulsion personal watercraft according to an embodiment of the present invention will be described with reference to accompanying drawings. Referring now to FIG. 1, a straddle-type personal watercraft equipped with a seat 7 configured to be straddled by a rider is shown. A body 1 of the watercraft comprises a hull 2 and a deck 3 covering the hull 2 from above. The hull 2 and the deck 3 are joined to each other at their peripheral edge portions to form a joint portion joining the hull 2 and the deck 3. The joint portion extends over the entire periphery of the body to form a gunnel 4. The gunnel 4 is located above a waterline 5 of the watercraft being at rest on the water. The gunnel 4 does not contact the water in a normal travel state, but may contact the water while the body 1 turns to the right or to the left in an inclined condition.

Figure 2:
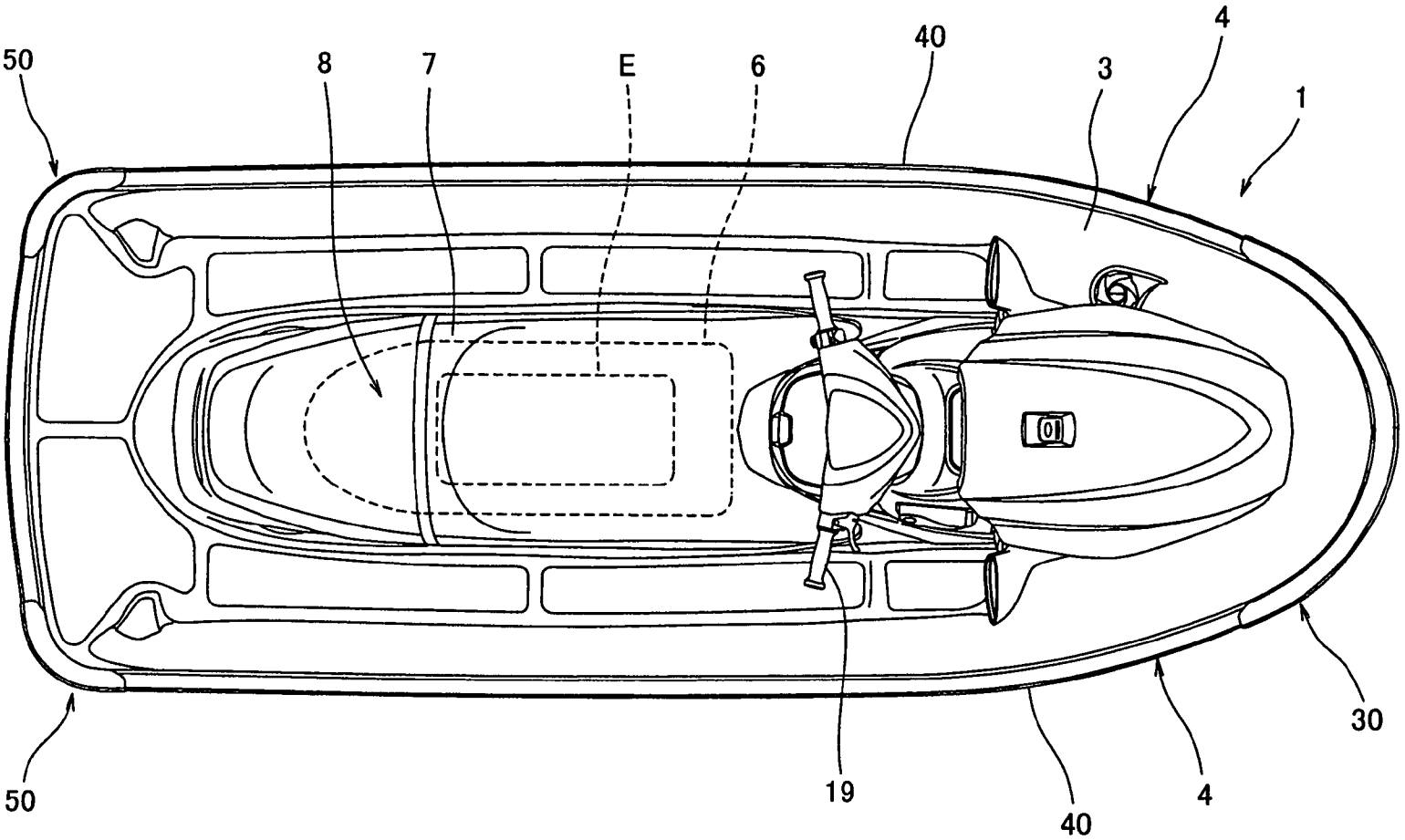
FIG. 2 is a plan view of the personal watercraft in FIG. 1.

As shown in FIG. 2, a deck opening 16, which has a substantially rectangular shape as seen from above is formed at a substantially center section of the deck 3 in the upper portion of the body 1 such that its longitudinal direction corresponds with the longitudinal direction of the body 1. The straddle seat 7 is removably mounted over the deck opening 16.

An engine room 8 is provided in a space defined by the hull 2 and the deck 3 below the opening 6. An engine E is mounted in the engine room 8 and configured to drive the watercraft. The engine room 8 has a convex transverse cross-section such that its width is smaller in its upper portion than in its lower portion. As shown in FIG. 1, the engine E is accommodated in the engine room 8 such that a crankshaft 9 extends along the longitudinal direction of the body 1.

An output end of the crankshaft 9 is rotatably and integrally coupled with a pump shaft 11 of a water jet pump P provided on the rear side of the body 1 through a drive shaft 10. An impeller 12 is attached on the pump shaft 11. Fairing vanes 13 are provided behind the impeller 12. The impeller 12 is covered with a pump casing 14 on the outer periphery thereof.

A water intake 15 is provided on the bottom of the body 1. The water intake 15 is connected to the pump casing 14 through a water intake passage. The pump casing 14 is connected to a pump nozzle 16 provided on the rear side of the body 1. The pump nozzle 16 has a cross-sectional area which gradually reduces rearward, and an outlet port 17 provided on the rear end of the pump nozzle 16.

The water is sucked from the water intake 15 and fed to the water jet pump P. The water jet pump P pressurizes and accelerates the water and the fairing vanes 13 guide water flow behind the impeller 12. The water is ejected through the pump nozzle 16 and from the outlet port 17, and as a reaction of the ejecting water, the watercraft obtains a propulsion force.

A bar-type steering handle 19 is attached to a front portion of the deck 3. The steering handle 19 is connected to a steering nozzle 20 provided behind the pump nozzle 16 through a cable (not shown). When the rider rotates the handle bar 19 clockwise or counterclockwise, the steering nozzle 20 is swung toward the opposite direction so that the ejection direction of the water being ejected through the pump nozzle 16 can be changed and the watercraft can be correspondingly turned to any desired direction while the water jet pump P is generating the propulsion force.

As shown in FIG. 1, a bowl-shaped bucket 22 is disposed at the rear portion of the body 1 and above the steering nozzle 20. The bucket 22 is capable of vertically swinging around a swinging shaft 23 horizontally mounted in the lateral direction of the watercraft. When the bucket 22 is swung downward to a lower position around the swinging shaft 23 to deflect the water ejected rearward from the steering nozzle 20 substantially forward, and as the resulting reaction, the personal watercraft moves rearward.

Figure 3:
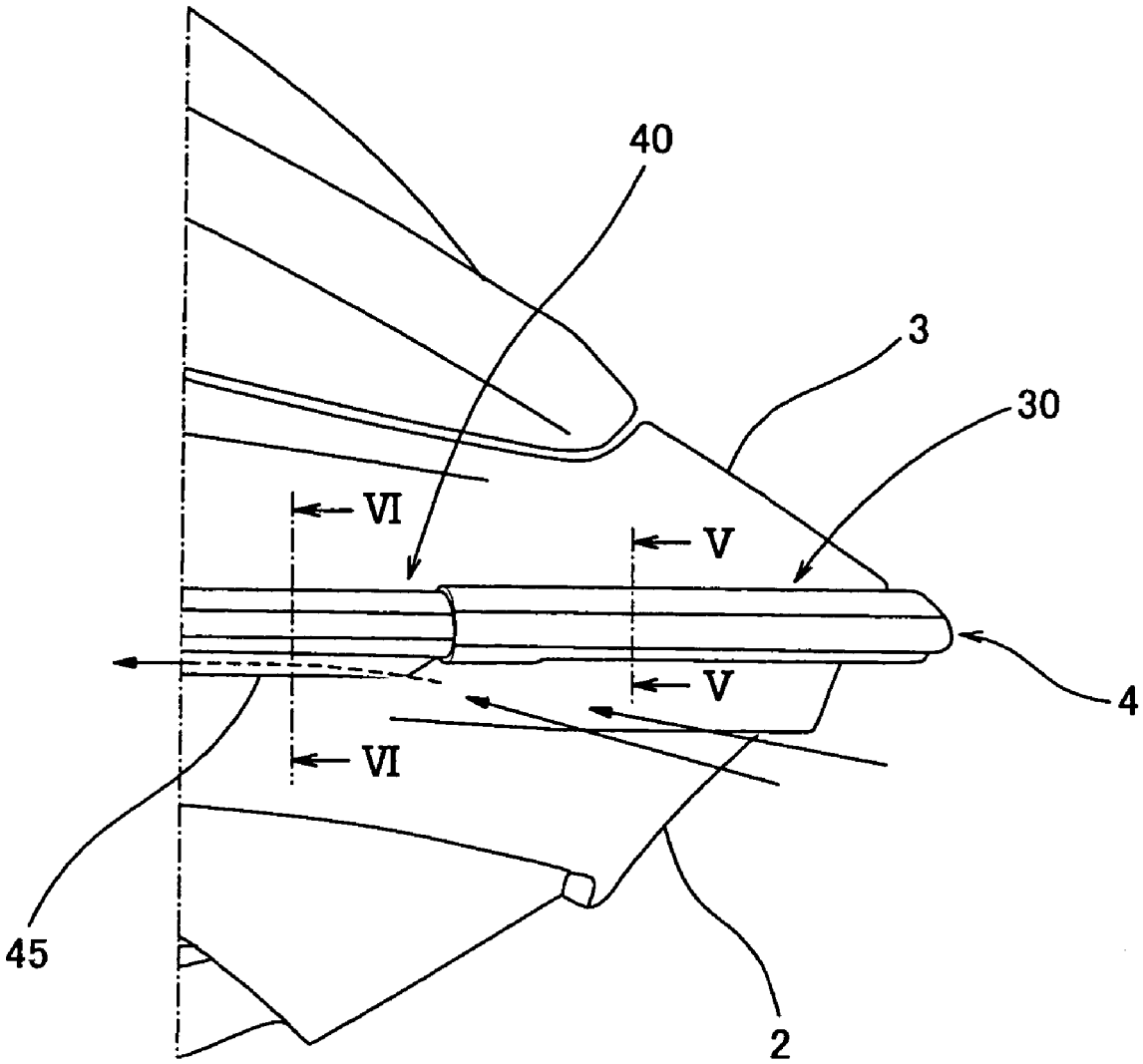
FIG. 3 is a side view of an enlarged front end portion of the personal watercraft in FIG. 1.
Figure 4:
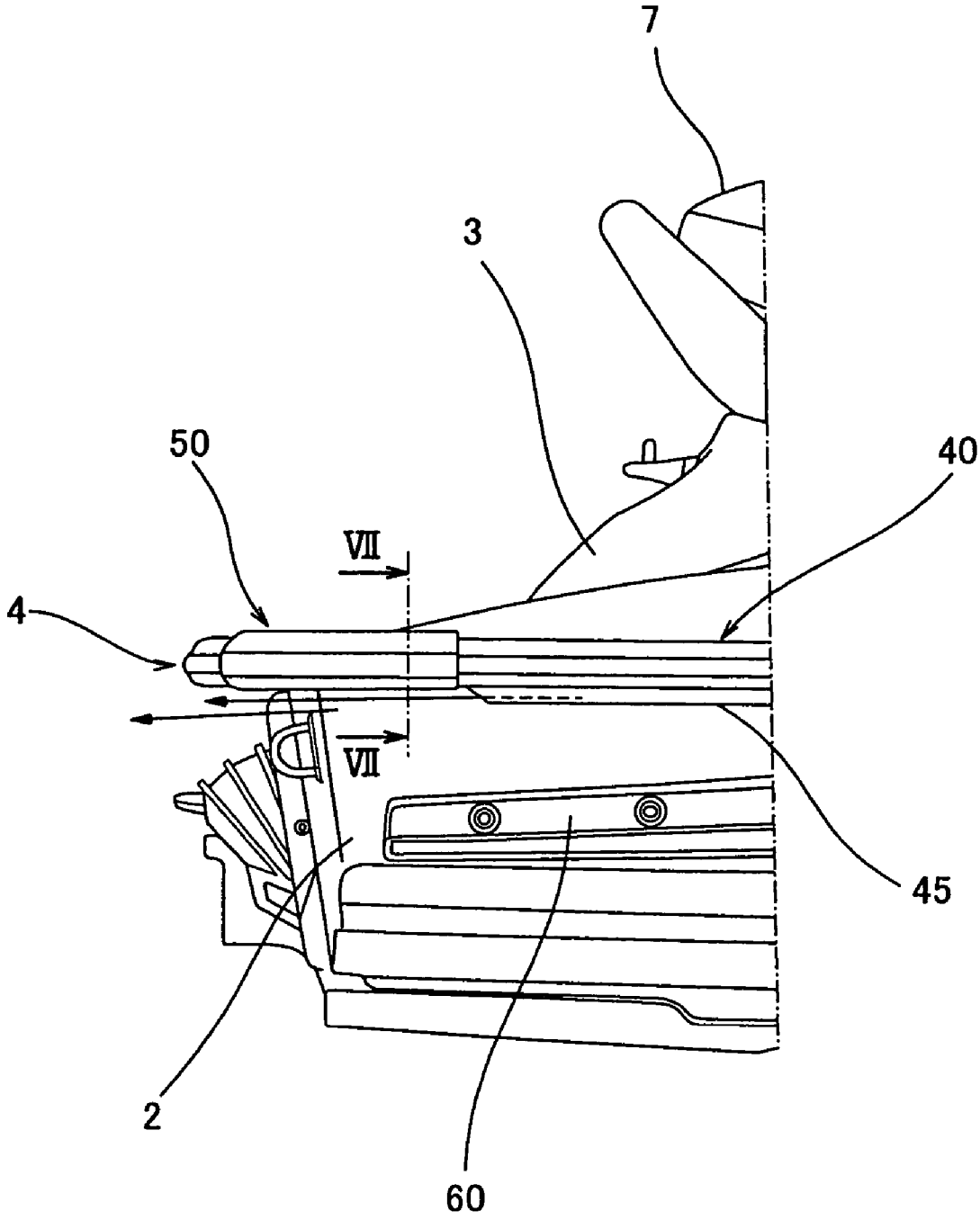
FIG. 4 is a side view of an enlarged rear end portion of the personal watercraft in FIG. 1.

FIG. 3 is a side view showing an enlarged front end portion of the above constructed personal watercraft. FIG. 4 is a side view showing an enlarged rear end portion of the personal watercraft. As shown in FIGS. 1, 2, and 3, a front bumper 30 is mounted to a front end portion of the body 1 to extend along the gunnel 4. In addition, side bumpers 40 are mounted to right and left side portions of the body 1 to extend rearward from the front bumper 30 along the gunnel 4. Further, as shown in FIGS. 1 and 2, and 4, rear bumpers 50 are mounted to right and left corner portions of a rear end portion of the body 1 along the gunnel 4. Also, sponsons 60 are respectively mounted to side portions of the hull 2 to be located forward and downward relative to the rear bumpers 50. As shown in FIG. 1, the side bumpers 40 extend over and cover a region of the gunnel 4 between the front bumper 30 and the rear bumpers 50.

Figure 5:
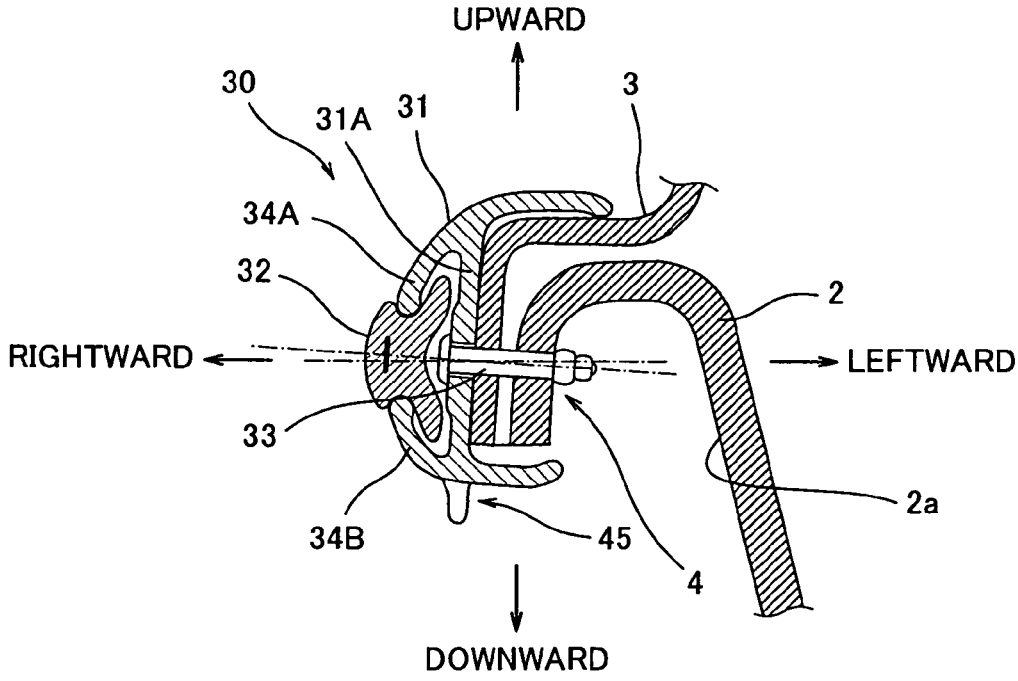
FIG. 5 is a cross-sectional view of a front bumper in FIG. 3 taken along line V—V in FIG. 3.

FIG. 5 is a cross-sectional front view of the front bumper 30 in FIG. 3 taken along line V—V in FIG. 3. As shown in FIG. 5, the front bumper 30 which is made of synthetic resin includes a base portion 31 which is channel shaped in transverse cross-section and a cushion portion 32, and is mounted to the gunnel 4 such that the base portion 31 covers the gunnel 4.

More specifically, the gunnel 4 is inverted-L shaped substantially over the entire periphery of the body 1. The channel-shaped base portion 31 covers upper and lower portions and an outer portion of the gunnel 4. The base portion 31 is fixed to the gunnel 4 by means of an attaching member 33 mounted to penetrate through the base portion 31 and the gunnel 4 from outside. And, flexible retaining portions 34A and 34B protrude from an upper end portion and a lower end portion of an outer portion (side wall portion) 31A of the base portion 31 and are configured to retain the cushion portion 32 from above and from below. The retaining portions 34A and 34B extend along a longitudinal direction of the base portion 31. The upper retaining portion 34A extends outward and downward and the lower retaining portion 34B extends outward and upward. And, the cushion portion 32 is retained by the upper and lower retaining portions 34A and 34B to be spaced a small distance apart from the outer surface of the outer portion 31A of the base portion 31. The attaching member 33 penetrates between the upper and lower retaining portions 34A and 34B of the base portion 31 from outside. With the cushion portion 32 retained between the retaining portions 34A and 34B, the attaching member 33 is covered with the cushion member 32 from outside.

When an impact is externally applied to the cushion portion 32 of the front bumper 30, the impact is alleviated because of elasticity of the cushion portion 32 and the base portion 31. In addition, the impact is further alleviated by deformation of the retaining portions 34A and 34B retaining the cushion portion 32.

Figure 6:
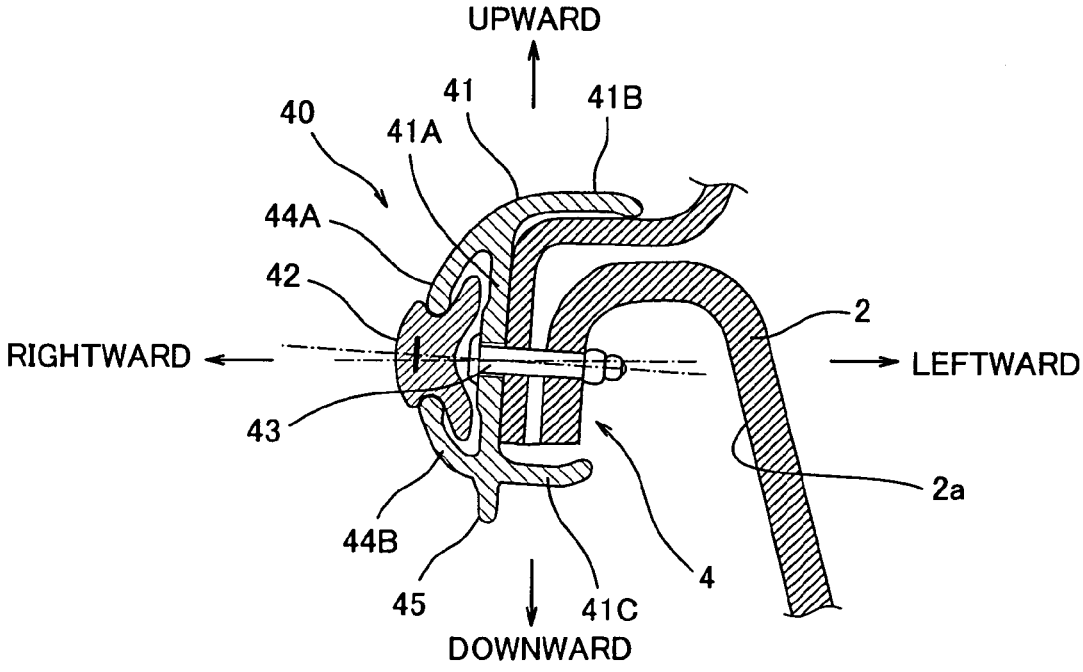
FIG. 6 is a cross-sectional view of a side bumper in FIG. 3 taken along line VI—VI in FIG. 3.

FIG. 6 is a cross-sectional front view of the side bumper 40 in FIG. 3, taken along line VI—VI in FIG. 3. As shown in FIG. 6, the side bumper 40 which is made of synthetic resin includes a base portion 41 which is channel shaped in transverse cross-section and a cushion portion 42, and is mounted to the gunnel 4 such that the base portion 41 covers a part of the gunnel 4.

More specifically, the base portion 41 of the side bumper 40 is substantially channel shaped such that an upper surface portion 41B and a lower surface portion 41C extend substantially horizontally toward the center of the body 1 from an upper end portion and a lower end portion of the side surface portion 41A, respectively, and is configured to cover the upper and lower portions and the outer portion of the gunnel 4. Further, the base portion 41 is fixed to the gunnel 4 by means of an attaching member 43 mounted to penetrate through the base portion 41 and gunnel 4 from outside.

Flexible retaining portions 44A and 44B protrude from an upper end portion and a lower end portion of the side surface portion 41A of the base portion 41 and are configured to retain the cushion portion 42 from above and from below. The retaining portions 44A and 44B extend along the longitudinal direction of the base portion 41. Further, the upper retaining portion 44A extends outward and downward and the lower retaining portion 44B extends outward and upward. The cushion portion 42 is retained by the upper and lower retaining portions 44A and 44B to be spaced a small distance apart from an outer surface of the side surface portion 41A of the base portion 41. The attaching member 43 penetrates between the upper and lower retaining portions 44A and 44B of the base portion 41 from outside. With the cushion portion 42 retained between the retaining portions 44A and 44B, the attaching member 43 is covered with the cushion member 42 from outside. The above structured side bumpers 40 serve to alleviate an impact as in the above described front bumper 30.

As shown in FIG. 6, a protruding portion 45 extends downward from the lower surface portion 41C of the base portion 41 by a predetermined length to a predetermined position to be spaced a distance apart from a side wall 2*a* of the hull 2. In this embodiment, the protruding portion 45 extends over substantially the entire length of the side bumpers 40. When the watercraft is turning, the protruding portion 45 is submerged in water, and creates a water flow between the protruding portion 45 and the side wall 2*a* of the hull 2 to serve as a stabilizer. And, while the watercraft is traveling straight ahead, the protruding portion 45 is exposed over the water surface, and therefore, an increase in travel resistance caused by the protruding portion 45 contacting the water is inhibited.

As shown in FIG. 5, the protruding portion 45 protrudes downward from the side bumper 40 to be located lower than the lower surface of the base portion 31 of the front bumper 30, as seen in a front view of the cross-section of the front bumper 30 taken along line V—V in FIG. 3. In this structure, when the watercraft is turning, the water flow running from forward toward the protruding portion 45 is not substantially inhibited by the front bumper 30 and is smoothly guided into a region between the protruding portion 45 and the side wall 2*a* of the hull 2. So, the protruding portion 45 suitably functions as a stabilizer. Further, as shown in FIG. 6, the protruding portion 45 extends downward along an extended line of the side surface portion 41A of the base portion 41 to be located lower than the side surface portion 41A. Therefore, the base portion 41 is easily bent to conform in shape to the gunnel 4 to facilitate mounting of the side bumper 40 to the gunnel 4. As shown in FIG. 2, although a portion of the gunnel 4 which is located behind the front bumper 30 is slightly curved as seen in a plan view, the side bumper 40 is easily bent to conform in shape to the gunnel 4 to be mounted to the gunnel 4.

Figure 7:
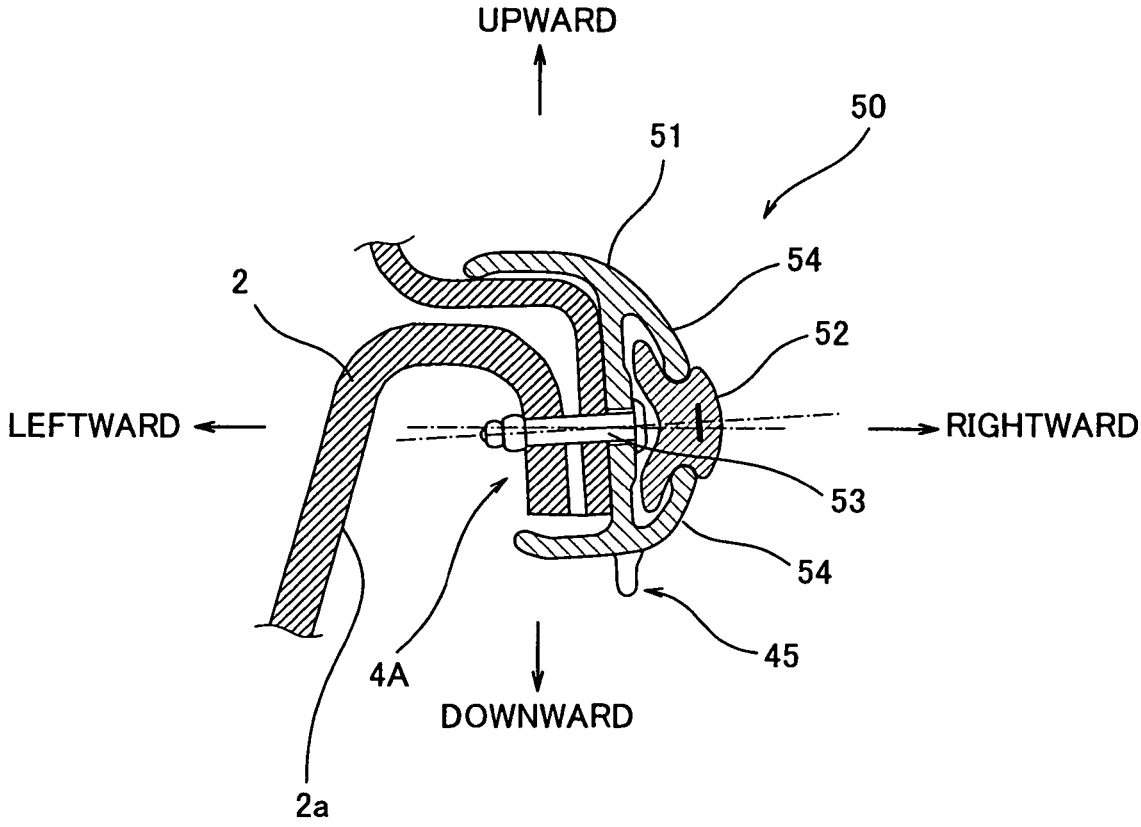
FIG. 7 is a cross-sectional view of a rear bumper in FIG. 4 taken along line VII—VII in FIG. 4.

FIG. 7 is a cross-sectional view of the rear bumper 50 in FIG. 4, taken along line VII—VII in FIG. 4. As shown in FIG. 7, the rear bumper 50 which is made of synthetic resin includes a base portion 51 which is channel shaped in transverse cross-section and a cushion portion 52, and is mounted to the gunnel 4 such that the base portion 51 covers the gunnel 4. The base portion 51 is configured to cover upper and lower portions and an outer portion of the gunnel 4. The base portion 51 is fixed to the gunnel 4 by means of an attaching member 53 mounted to penetrate through them from outer side.

Flexible retaining portions 54A and 54B protrude from an upper end portion and a lower end portion of an outer portion of the base portion 51 and configured to retain the cushion portion 52 from above and from below. The retaining portions 54A and 54B extend along the longitudinal direction of the base portion 51. And, the upper retaining portion 54A extends outward and downward and the lower retaining portion 54B extends outward and upward. The cushion portion 52 is retained by the upper and lower retaining portions 54A and 54B to be spaced a small distance apart from an outer surface of the base portion 51. The attaching member 53 penetrates between the upper and lower retaining portions 54A and 54B of the base portion 51 from outside. With the cushion member 52 retained between the retaining portions 54A and 54B, the attaching member 53 is covered with the cushion member 52 from outside. The rear bumper 50 serves to alleviate an impact as in the front bumper 30.

As shown in FIG. 7, as seen in a rear view of the cross-section of the rear bumper 50 taken along line VII—VII in FIG. 4, the protruding portion 45 provided on the side bumper 40 protrudes downward to be located lower than a lower surface of the base portion 51 of the rear bumper 50. In this structure, when the watercraft is turning, the protruding portion 45 is submerged in water, and the water flow is formed between the protruding portion 45 and the side portion of the hull 2. And, the water flow is not substantially inhibited by the rear bumper 50 and is smoothly ejected from the rear portion of the body 1. In this manner, the protruding portion 45 suitably functions as a stabilizer.

Figure 8:
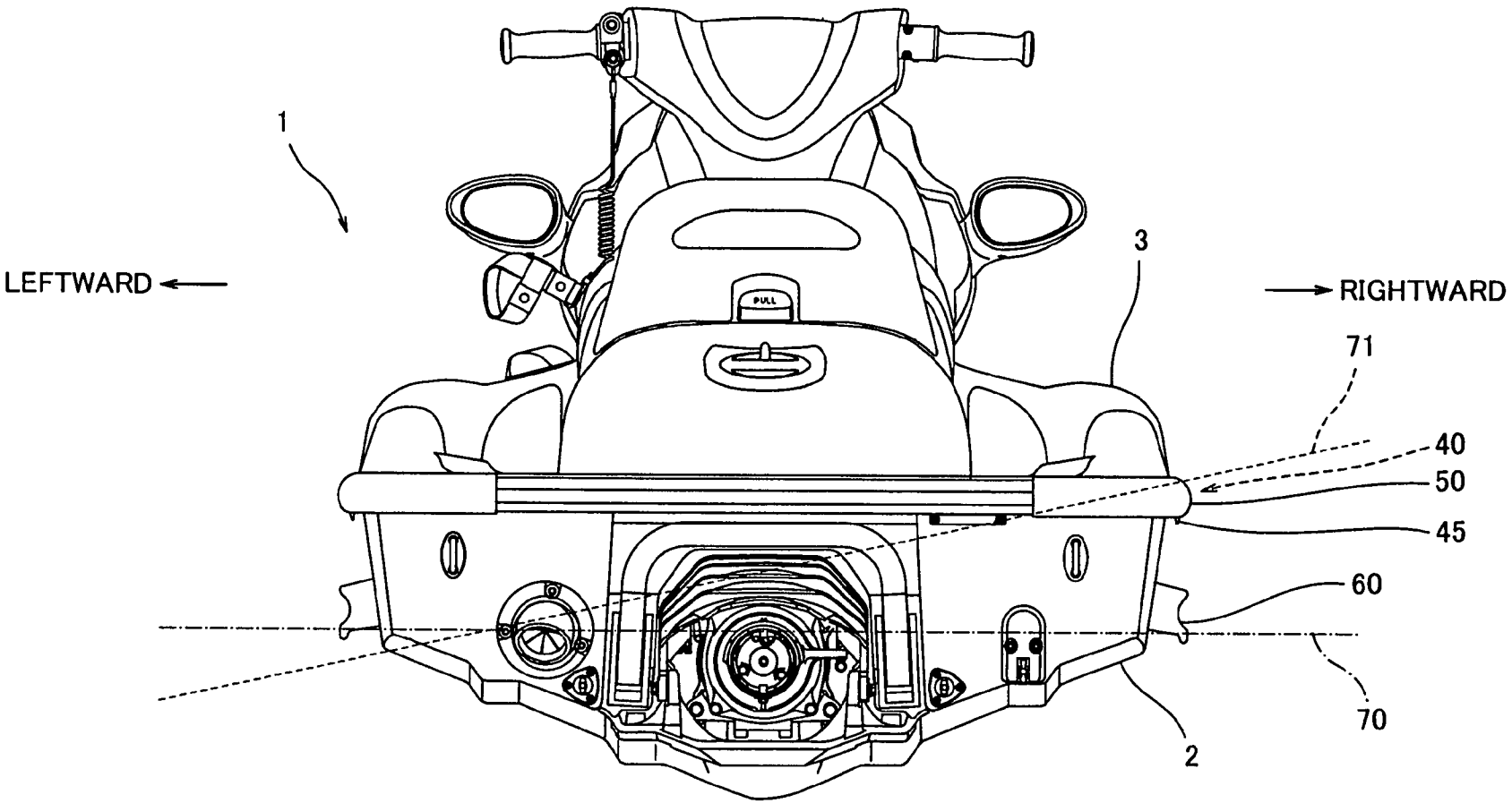
FIG. 8 is a rear view showing a state in which the personal watercraft in FIG. 1 is traveling straight ahead and turning.

FIG. 8 is a rear view of the above constructed personal watercraft in a straight-ahead position or a turning position. As shown in FIG. 8, while the watercraft is traveling straight ahead, a waterline 70 (indicated by a two-dot line) is located below the protruding portion 45 of the side bumper 40, and the sponson 60 is in contact with the water surface. Therefore, while the watercraft is traveling straight ahead, predetermined straight-ahead travel capability is gained by the function of the sponson 60 while inhibiting an increase in travel resistance which may be caused by the protruding portion 45 of the side bumper 40 contacting water.

When the watercraft is turning, for example, to the right as shown in FIG. 8, the body 1 is inclined and a waterline 71 (indicated by a broken line) is located above the right side bumper 40. Under this condition, the protruding portion 45 of the right side bumper 40 is submerged in water and functions as the stabilizer to gain predetermined turning capability. In this embodiment, the personal watercraft is a straddle-type watercraft, and the center of gravity is located near the center of the body 1 in the longitudinal direction during travel. Therefore, when the watercraft turns and the body 1 is inclined, substantially the entire length of the right side bumper 40 is submerged in water. Since the protruding portion 45 extends substantially over the entire length of the right side bumper 40 as described above, a substantial portion of the protruding portion 45 extending in the longitudinal direction contacts the water during turning. As a result, higher turning capability is gained.

Figure 9:
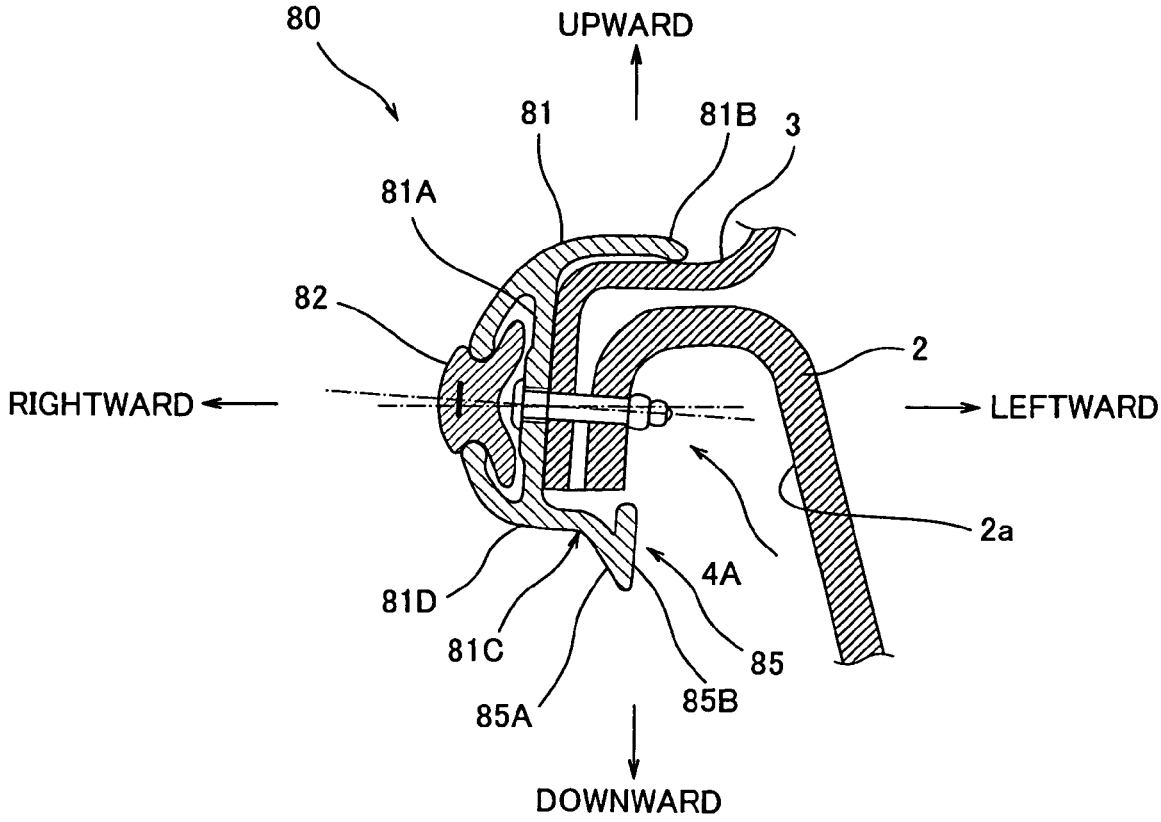
FIG. 9 is a cross-sectional view showing another structure of the side bumper.

The structure of the protruding portion 45 provided on the side bumper 40 is not intended to be limited to that shown in FIG. 6. FIG. 9 is a transverse cross-sectional view of a side bumper 80 provided with a protruding portion having another structure. As shown in FIG. 9, the side bumper 80 includes a base portion 81 and a cushion portion 82 as in the side bumper 40 in FIG. 6. The base portion 81 of the side bumper 80 is substantially channel shaped such that an upper surface portion 81B and a lower surface portion 81C extend substantially horizontally toward the center of the body 1 from an upper end portion and a lower end portion of the side surface portion 81A, respectively, and configured to cover the upper and lower portions and the outer portion of the gunnel 4.

The lower surface portion 81C of the side bumper 80 has a protruding portion 85. The lower surface portion 81C of the side bumper 80 includes a horizontal portion 81D extending in one direction of the horizontal direction, an inclined portion 85A extending downward to be curved from a tip end portion of the horizontal portion 81D to a predetermined position, and a vertical portion 85B extending substantially vertically upward from a lower end of the inclined portion 85A to a predetermined position. The protruding portion 85 is formed by the inclined portion 85A and the vertical portion 85B, and protrudes from the lower surface of the horizontal portion 81D to a predetermined position to be spaced a distance apart from the side wall 2*a* of the hull 2. The protruding portion 85 is submerged in water when the watercraft is turning, and functions as the stabilizer as in the protruding portion 45 of the side bumper 40. The other construction features and functions are substantially identical to those of the side bumper 40, and will not be further described.

While the protruding portion 45 extends over substantially the entire length of the side bumper 40 so as to correspond to the distance between the front bumper 30 and the rear bumper 50, it may alternatively be shortened and positioned depending on the position of the center of gravity of the watercraft. For example, the protruding portion 45 may extend over the side bumper 40 so as to correspond to substantially half of the distance between the front bumper 30 and the rear bumper 50. In that case, since the center of gravity of the watercraft is typically located rearward, it is desirable to also locate the protruding portion at a rear portion of the body. In other words, the center of the protruding portion in the longitudinal direction may be located rearward in the body relative to the center of the body in the longitudinal direction. Also, the protruding portion may be located rearward in the body relative to the center of the body in the longitudinal direction. By doing so, the protruding portion contacts the water when the watercraft is turning, and thereby turning capability is improved.

The above described construction may be applicable to a stand-up type personal watercraft on which a rider rides in a standing or kneeling position on a deck floor, as well as to the straddle-type personal watercraft.

While in the above construction, the side bumper is separate from the front and rear bumpers, it may be entirely or partially integral with the front or rear bumper. In that case, the protruding portion of the side bumper may be provided at a suitable location of a side portion of the body.

As this invention may be embodied in several forms without departing from the spirit of essential characteristics thereof, the present embodiments is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A water-jet propulsion personal watercraft, comprising:

a body formed by a hull and a deck covering the hull from above, the body having a joint portion joining the hull and the deck joined to each other at peripheries thereof, the body being configured to accommodate an engine configured to drive a propulsion system of the watercraft; and a side bumper mounted to the joint portion at a side portion of the body, wherein the side bumper includes a base portion mounted to the joint portion to extend along the joint portion in a longitudinal direction of the body, and a protruding portion configured to extend along the base portion in the longitudinal direction and to protrude downward from a lower surface of the base portion to be spaced apart from a side wall of the hull, the protruding portion having a side surface forming a substantially vertical surface in the vicinity of the side wall of the hull.

2. The water-jet propulsion personal watercraft according to claim 1, further comprising:

a front bumper mounted to the joint portion of the hull and the deck to be located at a front portion of the body; and a rear bumper mounted to the joint portion of the hull and the deck to be located at a rear portion of the body, wherein, the protruding portion of the side bumper extends over a length equal to not less than a half of a distance between the front bumper and the rear bumper.

3. The water-jet propulsion personal watercraft according to claim 2, wherein a center of the protruding portion in the longitudinal direction is located rearward in the body relative to a center of the body in the longitudinal direction.

4. The water-jet propulsion personal watercraft according to claim 2, wherein the protruding portion of the side bumper is configured to protrude downward to be located lower than a lower surface of the front bumper as seen in a front view of the body.

5. The water-jet propulsion personal watercraft according to claim 2, wherein the protruding portion of the side bumper is configured to protrude downward to be located lower than a lower surface of the rear bumper as seen in a rear view of the body.

6. The water-jet propulsion personal watercraft according to claim 2, further comprising a seat mounted over the deck and configured to be straddled by a rider, wherein the watercraft is a straddle-type watercraft on which a rider rides straddling the seat.

7. The water-jet propulsion personal watercraft according to claim 1, wherein the protruding portion is located rearward in the body relative to a center of the body in the longitudinal direction.

8. The water-jet propulsion personal watercraft according to claim 1, wherein the protruding portion has a substantially constant thickness in a lateral direction of the body.

9. The water-jet propulsion personal watercraft according to claim 8, wherein the base portion includes a side surface portion extending along the joint portion in the longitudinal direction of the body so as to form a vertical surface, and the protruding portion extends downward substantially along an extended line of the side surface portion of the base portion.

10. The water-jet propulsion personal watercraft according to claim 1, wherein the joint portion has a vertical wall portion forming a vertical surface on a center side in the lateral direction of the body, and the vertical surface of the protruding portion extends downward substantially along an extended line of the vertical surface of the vertical wall portion of the joint portion.

11. A water-jet propulsion personal watercraft, comprising:

a body formed by a hull and a deck covering the hull from above, the body having a joint portion joining the hull and the deck joined to each other at peripheries thereof, the body being configured to accommodate an engine configured to drive a propulsion system of the watercraft;

a side bumper mounted to the joint portion at a side portion of the body;

a front bumper mounted to the joint portion of the hull and the deck to be located at a front portion of the body; and a rear bumper mounted to the joint portion of the hull and the deck to be located at a rear portion of the body;

wherein the side bumper includes a base portion mounted to the joint portion to extend along the joint portion in a longitudinal direction of the body, and a protruding portion configured to extend along the base portion in the longitudinal direction and to protrude downward from a lower surface of the base portion to be spaced apart from a side wall of the hull; and wherein the protruding portion of the side bumper is configured to protrude downward to be located lower than a lower surface of the front bumper as seen in a front view of the body.

12. The water-jet propulsion personal watercraft according to claim 11, wherein the protruding portion of the side bumper extends over a length equal to not less than a half of the distance between the front bumper and the rear bumper.

13. A water-jet propulsion personal watercraft, comprising:

a body formed by a hull and a deck covering the hull from above, the body having a joint portion joining the hull and the deck joined to each other at peripheries thereof, the body being configured to accommodate an engine configured to drive a propulsion system of the watercraft;

a side bumper mounted to the joint portion at a side portion of the body;

a front bumper mounted to the joint portion of the hull and the deck to be located at a front portion of the body; and a rear bumper mounted to the joint portion of the hull and the deck to be located at a rear portion of the body;

wherein the side bumper includes a base portion mounted to the joint portion to extend along the joint portion in a longitudinal direction of the body, and a protruding portion configured to extend along the base portion in the longitudinal direction and to protrude downward from a lower surface of the base portion to be spaced apart from a side wall of the hull; and wherein the protruding portion of the side bumper is configured to protrude downward to be located lower than a lower surface of the rear bumper as seen in a rear view of the body.

14. The water-jet propulsion personal watercraft according to claim 13, wherein the protruding portion of the side bumper extends over a length equal to not less than a half of a distance between the front bumper and the rear bumper.

* * * * *